United States Patent [19]

Ohori et al.

[11] Patent Number: 5,011,656

[45] Date of Patent: Apr. 30, 1991

[54] STEELS FOR HOT WORKING PRESS TOOLS

[75] Inventors: Manabu Ohori; Noriaki Koshizuka; Yoshihiro Kataoka; Shuzo Ueda, all of Chiba, Japan

[73] Assignee: Kawaski Steel Corporation, Japan

[21] Appl. No.: 284,706

[22] Filed: Dec. 15, 1988

[30] Foreign Application Priority Data

Apr. 20, 1988 [JP] Japan ..... 63-95436

[51] Int. Cl.[5] ..... C22C 38/22; C22C 38/44

[52] U.S. Cl. ..... 420/109; 420/40; 420/63; 420/69; 420/111

[58] Field of Search ..... 420/109, 40, 63, 69, 420/111

[56] References Cited

U.S. PATENT DOCUMENTS 4,853,181 8/1989 Wert et al. ..... 420/111
4,957,701 9/1990 Masuyama et al. ..... 420/111

FOREIGN PATENT DOCUMENTS 53-103918 9/1978 Japan ..... 420/69
55-69247 5/1980 Japan ..... 420/109
58-123859 7/1983 Japan ..... 420/111

*Primary Examiner*—Deborah Yee
*Attorney, Agent, or Firm*—Parkhurst, Wendel & Rossi

[57] ABSTRACT

A steel suitable for a hot working press tool used for a slab width sizing press comprises particular amounts of C, Si, Cr, Mn, Mo, V and N having a specific Cr equivalent, or particular amounts of C, Si, Mn, Mo, V, Cr and Ni having a specified Cr/Ni ratio.

3 Claims, 5 Drawing Sheets

Depth of Notch-Like Scale $l = \frac{l_1 + l_2 + \cdots + l_{10}}{10}$

STEELS FOR HOT WORKING PRESS TOOLS

BACKGROUND OF THE INVENTION

1. Field of the Invention

This invention relates to steels for hot working press tools used in the continuous reduction of slab width.

2. Related Art Statement

When slabs of various sizes are produced by the continuous casting method, it is necessary to provide a mold for continuous casting in correspondence to each size of the slabs, so that there is a problem of decreasing the productivity through the exchange of the mold. Therefore, it is desired to arrange various sizes of the molds into some typical sizes.

For this purpose, there has been developed a slab width sizing press (hereinafter referred to as sizing press) in which the width of the hot slab after the continuous casting is reduced in the widthwise direction over a full length of the slab ranging from the head to the tail in accordance with a size of the slab to be reduced, by repeatedly applying a pressure in the widthwise direction to the hot slab through a pressing tool (hereinafter referred to as anvil) every relative feeding of the slab to the anvil. In this case, the anvil used in the sizing press is subjected to a thermal load, so that the cracking due to thermal stress may result. Therefore, an anvil having a high resistance to thermal fatigue is demanded for preventing a decrease of productivity through the exchange of the anvil.

The steels for hot working used in a press die, forging die and the like have a standard according to JIS G4404 together with steels for cutting tools, impact tools, cold working dies and the like, some of which are disclosed in Japanese Patent Application Publication No. 54-38,570.

These steels for hot working are sufficiently durable for ordinary hot working, but are still insufficient for use in the anvil in the sizing press. The anvil for the sizing press is large in size and is continuously used for the hot slab above 1,200° C., so that the temperature of the anvil becomes high up to the deep inside thereof as compared with the hot rolling roll. Consequently excessive thermal stress is caused during cooling and there is a problem of causing cracking due to thermal fatigue.

SUMMARY OF THE INVENTION

It is, therefore, an object of the invention to provide steels having a high resistance to thermal fatigue and suitable for use in hot working press tools under severe use conditions as in a sizing press or the like.

According to a first aspect of the invention, the steel is a martensitic steel for a hot working press tool consisting essentially of Cr-Mo-V as a basic component and containing Si, Mn and N, which is usable for the sizing press. In this case, the presence of Cr and Si improves the oxidation resistance of steels, and the presence of Si, Mo and V raises the transformation temperature and restricts the upper limit of Cr equivalent to prevent the appearance of δ-ferrite inherent to high-Cr steel, whereby the resistance to thermal fatigue is improved. Thus, prevent the cracking of a hot working press tool such as an anvil or the like due to the thermal fatigue is prevented.

According to a second aspect of the invention, at least one of Al and a REM (rare earth metal) is added to the steel of the first invention, whereby the oxidation resistance is improved to further enhance the resistance to thermal fatigue.

According to a third aspect of the invention, the steel is a martensitic steel for a hot working press tool consisting essentially of Cr-Ni-Mo-V as a basic component and containing Si and Mn, which is usable for the sizing press. In this case, the notch-like high temperature oxide scale produced in the case of low Cr and high Ni is prevented by taking $Cr/Ni \geqq 5$, whereby the resistance to thermal fatigue is improved, thus preventing the cracking of the hot working die due to thermal fatigue.

That is, the first invention provides a steel for a hot working press tool used for continuously reducing a slab width, consisting essentially of C: 0.05–0.35 wt % (hereinafter merely shown by %), Si: 0.80–2.5%, Mn: 0.10–2.0%, Cr: 7.0–13.0%, Mo: 0.50–3.0%, V:0.10–0.60%, N: 0.005–0.10%, the balance being iron and inevitable impurities, and satisfying a Cr equivalent of not more than 16, represented by the following equation:

$$\text{Cr equivalent} = Cr + 6Si + 4Mo + 11V - 40C - 2Mn - 30N \text{ (wt \%)}.$$

The second invention provides a steel for a hot working press tool used for continuously reducing a slab width, consisting essentially of C: 0.05–0.35%, Si: 0.80–2.5%, Mn: 0.10–2.0%, Cr: 7.0–13.0%, Mo: 0.50–3.0%, V: 0.10–0.60%, N: 0.005–0.10%, the balance being iron and inevitable impurities, and further containing at least one of Al: 0.005–0.5% and a REM: 0.005–0.02%, and satisfying a Cr equivalent of not more than 16, represented by the following equation:

$$\text{Cr equivalent} = Cr + 6Si + 4Mo + 11V + 12Al - 40C - 2Mn - 30N \text{ (wt \%)}.$$

The third invention provides a steel for a hot working press tool used for continuously reducing a slab width, consisting essentially of C: 0.10–0.45%, Si: 0.10–2.0%, Mn: 0.10–2.0%, Mo: 0.50–3.0%, V: 0.50–0.80%, Cr: 3.0–8.0% and Ni: 0.05–1.2%, provided that $Cr/Ni \geqq 5$, the balance being iron and inevitable impurities.

Brief Description of the Drawings

The invention will be described with reference to the accompanying drawings, wherein.

Description of the Preferred Embodiments

The anvil aimed at the invention is subjected to not only a simple thermal stress but also a mechanical stress in a contact surface with the slab at a high temperature. As a result, the cracking is partially caused in the oxide layer, which is a starting point for the cracking through selective oxidation and thermal fatigue, resulting in the degradation of the resistance to thermal fatigue.

In order to solve this problem, steels having various chemical compositions were subjected to a high temperature fatigue test in an oxidizing atmosphere (in air) at a test temperature of 750° C. and a strain range of 0.7%, during which the occurrence and growth of cracks were measured. The results are shown in FIG. 1.

Figure 1:
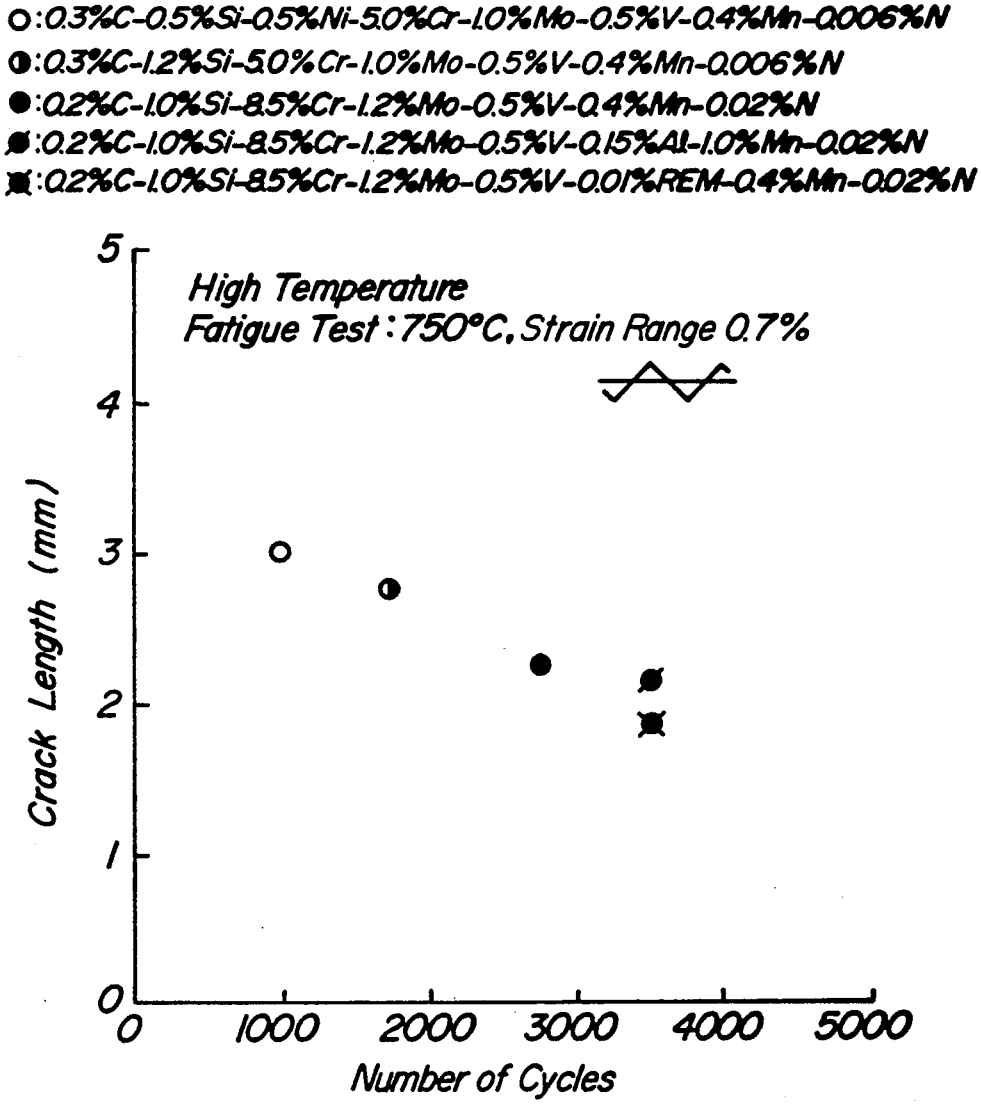
FIG. 1 is a graph showing a relation between number of cycles and crack length in the high temperature fatigue test.

As seen from FIG. 1, increasing the Cr and Si contents as well as adding Al a REM in the steel prevents the growth of cracks.

In the anvil aimed at the invention, the thermal fatigue becomes a problem, so that the presence of δ-fatigue ferrite being a stress concentration source is harmful. It is necessary to prevent the appearance of δ-ferrite.

In the first and second invention, the reason why the chemical composition of the steel is limited to the above defined range is as follows:

C: 0.05–0.35%

C is required to improve the hardenability and maintain the hardness, after quenching and tempering, and the strength at high temperature. Further, C forms carbides by reacting with Cr, Mo and V to thereby enhance the wear resistance and the softening resistance after the tempering. Moreover, C is necessary as an austenite forming element for preventing the appearance of δ-ferrite. If the C content is too large, the toughness is decreased and the transformation temperature is lowered, so that the upper limit should be 0.35%. On the other hand, when the C content is too small, the wear resistance is poor and the appearance of δ-ferrite result, so that the lower limit should be 0.05%.

Si: 0.80–2.0%

Si is added for maintaining the oxidation resistance and raising the transformation temperature. When the Si content is too large, the toughness is decreased, so that the upper limit is 2.0%. On the other hand, when it is too small, the effect is lost, so that the lower limit is 0.80%.

Mn: 0.10–2.0%

Mn is required to improve the hardenability and prevent the formation of δ-ferrite. When the Mn content is too large, the transformation temperature is lowered, so that the upper limit should be 2.0%, while when it is too small, the effect is lost, so that the lower limit should be 0.10%.

Cr: 7.0–13.0%

A part of Cr forms carbonitrides which precipitate in the matrix, whereby the wear resistance is improved. Further, the remaining Cr is soluted to improve the hardenability, whereby the hardness after quenching and tempering and the high-temperature strength are improved. Moreover, Cr is an element effective for improving the oxidation resistance at high temperature and raising the transformation temperature. When the Cr content is less than 7.0%, the effect is poor, while when it exceeds 13.0%, δ-ferrite appears to lower the resistance to thermal fatigue, so that the Cr content is limited to a range of 7.0–13.0%.

Mo: 0.50–3.0%

Mo is soluted into the matrix to improve the hardenability and also forms hard carbides by bonding with C to precipitate in the matrix, whereby the wear resistance is enhanced. Further, Mo enhances the softening resistance and increases the high-temperature strength through tempering and raises the transformation temperature. When the Mo content is more than 3.0%, the toughness is decreased, while when it is less than 0.5%, the sufficient effect is not obtained, so that the Mo content is limited to a range of 0.5–3.0%.

V: 0.10–0.60%

V precipitates fine carbonitrides to enhance the softening resistance and the high-temperature strength through tempering and raise the transformation temperature. However, when the V content is too large, a coarse carbide is formed which lowers the toughness, while when it is too small, the effect is not obtained, so that it is limited to a range of 0.10–0.60%.

N: 0.005–0.10%

N is added in an amount of not less than 0.005% for the improvement of high-temperature strength and the prevention of δ-ferrite formation. However, when it exceeds 0.10%, the toughness is considerably decreased, so that the upper limit is 0.10%.

In the second invention, at least one of Al: 0.005–0.2% and a REM: 0.005–0.02% is included in the steel.

Al is an element used for improving the toughness through an effect of fining crystal grains and further enhancing the oxidation resistance. For this purpose, Al is required to be added in an amount of 0.005%. However, when it exceeds 0.20%, coarse AlN may be formed, thus decreasing the toughness, so that the upper limit is 0.20%.

A REM (rare earth element) consisting essentially of La and Ce is a component for improving the oxidation resistance. For this purpose, it is required to be included in an amount of not less than 0.005%. When the amount exceeds 0.02%, the toughness is decreased, so that the upper limit is 0.02%.

In the first and second inventions, a Cr equivalent represented by the following equation, must not be more than 16.

$$\text{Cr equivalent} = \text{Cr} + 6\text{Si} + 4\text{Mo} + 11\text{V} + 12\text{Al} - 40\text{C} - 2\text{Mn} - 30\text{N (wt \%)}.$$

Figure 2:
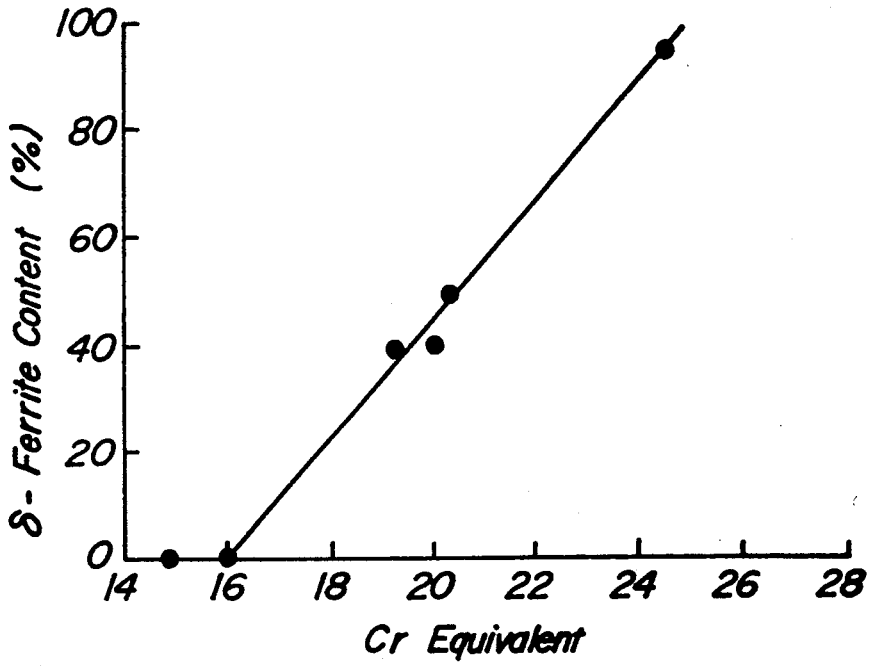
FIG. 2 is a graph showing a relation between a Cr equivalent and δ-ferrite content.

The Cr equivalent has a good relation to the appearance of δ-ferrite. In FIG. 2 are shown the results the effect of a Cr equivalent on δ-ferrite content when the Cr equivalent is changed by varying the chemical composition of the steel. As seen from FIG. 2, when the Cr equivalent exceeds 16, δ-ferrite is formed, while the appearance of δ-ferrite can be prevented by restricting the Cr equivalent to not more than 16.

In the third invention, the reason why the chemical composition of the steel is limited to the above defined range is as follows:

C: 0.10–0.45%

C is required to improve the hardenability and maintain the hardness after quenching and tempering, and the strength at high temperature. Further, C forms carbides by reacting with Cr, Mo and V to thereby enhance the wear resistance and the softening resistance after the tempering. If the content of C is too large, the toughness is decreased, so that the upper limit should be 0.45%. On the other hand, when it is less than 0.10%, the above effects are not obtained, so that the lower limit should be 0.10%.

Si: 0.10–2.0%

Si is added for maintaining the oxidation resistance and raising the transformation temperature. When the Si content is too large, the toughness is decreased, so that the upper limit is 2.0%. On the other hand, when it is too small, the effect is lost, so that the lower limit is 0.10%.

Mn: 0.10–2.0%

Mn is required to improve the hardenability. When the Mn content is too large, the Al transformation temperature is lowered, so that the upper limit should be 2.0%, while when it is too small, the effect is lost, so that the lower limit should be 0.10%.

Mo: 0.50–3.0%

Mo is soluted into the matrix to improve the hardenability and also forms hard carbides by bonding with C to precipitate in the matrix, whereby the wear resistance is enhanced. Further, Mo enhances the softening resistance through tempering and the high temperature strength, and raises the Al transformation temperature. When the Mo content is more than 3.0%, the toughness is decreased, while when it is less than 0.5%, the sufficient hardening depth is not obtained, so that the content is limited to a range of 0.5–3.0%.

V: 0.50–0.80%

V forms fine carbonitrides to enhance the softening resistance through tempering and the high-temperature strength. V makes the grain fine, whereby the toughness is increased, and raises the Al transformation temperature. However, when the V content is too large, a coarse carbide is formed to decrease the toughness, while when it is too small, the effect is not obtained, so that it is limited to a range of 0.5–0.8%.

Cr: 3.0–8.0%

Figure 3:
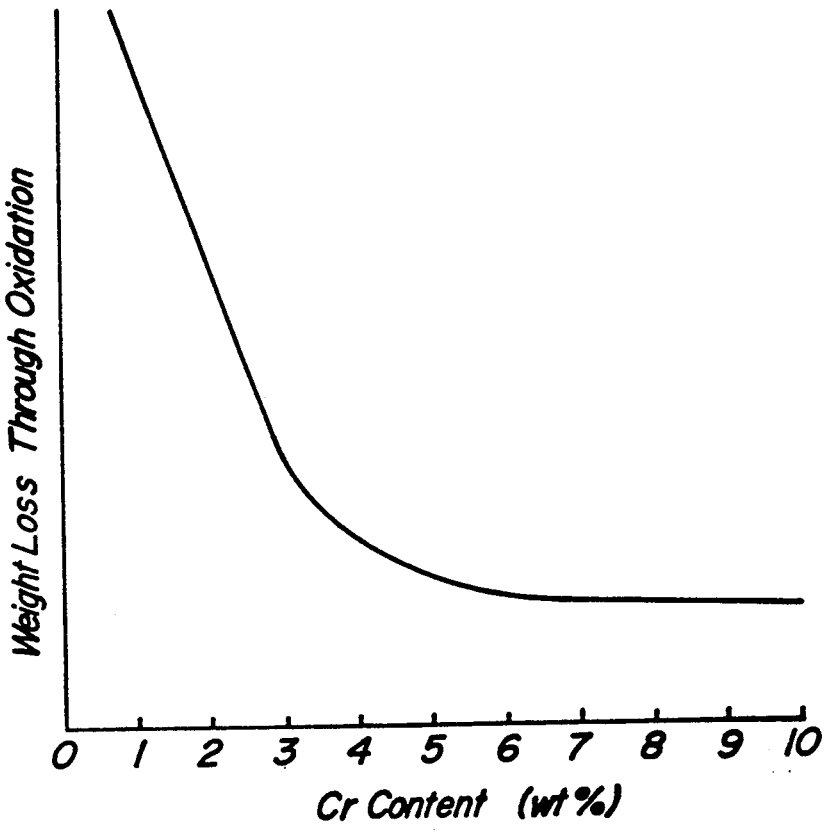
FIG. 3 is a graph showing a relation between Cr content and weight reduction through oxidation.

A part of Cr forms carbides to precipitate in the matrix to thereby improve the wear resistance, while the remaining Cr is soluted to increase the hardenability. Moreover, the hot working die for reducing the slab width comes into contact with the high temperature slabs which raise the temperature of the surface of the die itself, so that it is required to have an oxidation resistance at high temperature. In this connection, the presence of Cr can improve the latter property. However, as seen from FIG. 3, showing an influence of Cr content upon the weight loss through oxidation at high temperature, when the content is less than 3.0%, the effect is insufficient, while when it exceeds 8.0%, the effect is saturated and becomes disadvantageous economically, so that the Cr content is limited to a range of 3.0–8.0%. Moreover, FIG. 3 shows the experimental results when heating in air at 100° C for 48 hours.

Ni: 0.05–1.2%

Ni is an element useful for the improvement of toughness and hardenability and is added in an amount of not less than 0.05%. However, when the content exceeds 1.2%, the addition becomes disadvantageous economically, so that the Ni content is limited to a range of 0.05–1.2%.

Figure 4:
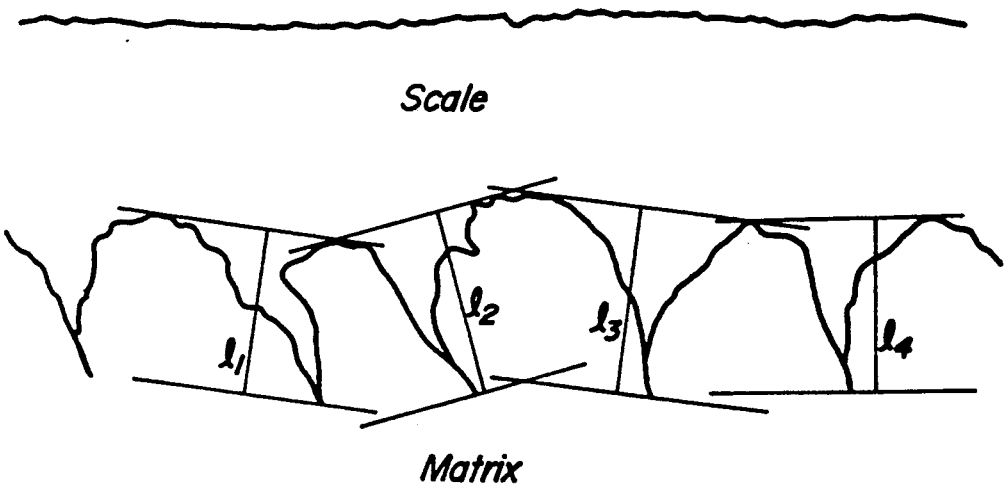
FIG. 4 is a diagrammatical view showing a notchlike scale.

On the other hand, when the steel is used in a large die for the sizing press, it is exposed to high temperature in use and subjected to large thermal stress in the cooling, so that cracking due to thermal fatigue is a greatest problem. In this connection, the presence of Ni decreases the resistance to thermal fatigue in the oxidizing atmosphere. That is, the presence of Ni promotes the selective oxidation and forms a notch-like scale through oxidation at high temperature as shown in FIG. 4. The notch-like scale further enlarges the cracking and decreases the resistance to thermal fatigue.

Figure 5:
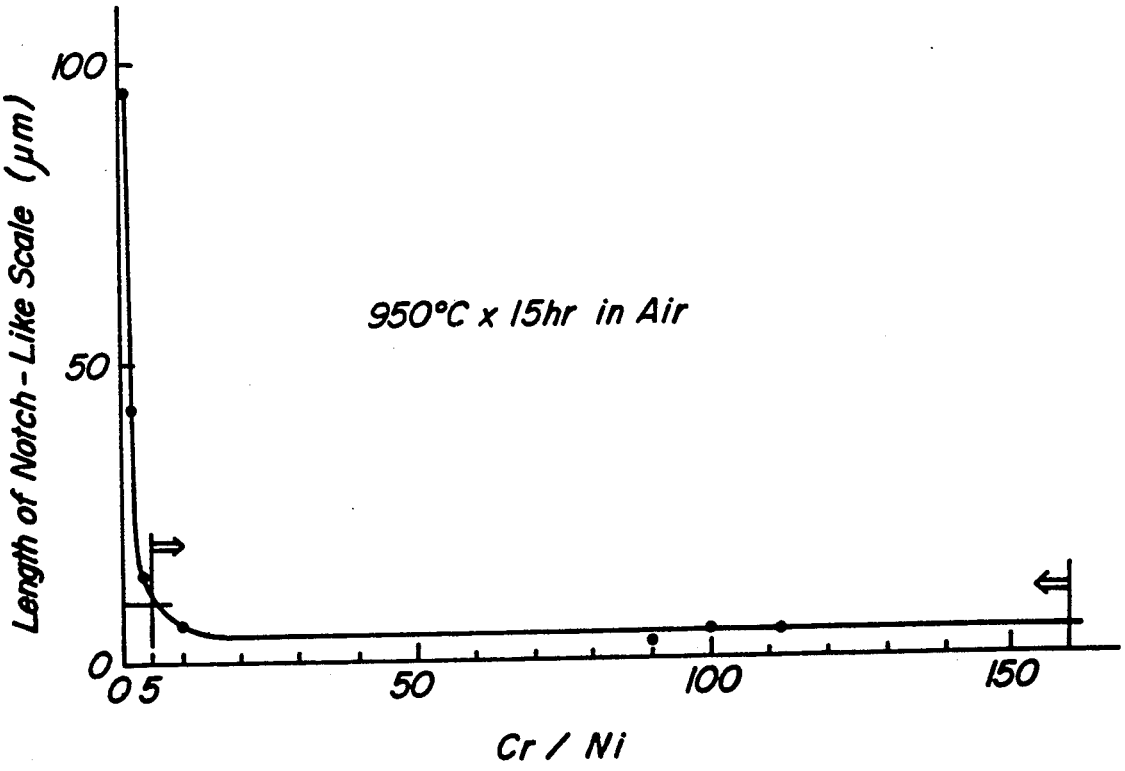
FIG. 5 is a graph showing a relation between Cr/Ni and length of the notch-like scale.

FIG. 5 shows an influence of Cr/Ni upon depth of the notch-like scale, from which it is apparent that the formation of the notch-like scale is restrained by the addition of Cr together with the Ni addition. The notch-like scale as shown in FIG. 4 is measured on test samples when steel ingots containing C: 0.40%, Si: 1.0%, Mn: 0.4%, Mo: 1.25% and V: 0.5% and further a variable amount of Ni: 0.05–1.65% and Cr: 1.21–7.9% were heated at 900° C. for 15 hours and cooled in air. The results are shown in FIG. 5 in comparison with the ratio Cr/Ni.

As seen from FIG. 5, when Cr/Ni≧5, the length of the notch-like scale can be restrained to not more than 10 μm. That is, the formation of the notch-like scale can substantially be suppressed and the resistance to thermal fatigue can be well held.

The steels according to the invention can be produced by melting a particular steel in a converter or an electric furnace, producing a steel ingot or slab from the melt through an ingot-making or continuous casting method, forging or rolling the ingot, for example, and subjecting the ingot to a heat treatment inclusive of normalizing-annealing- quenching-tempering. Then, the resulting steel is shaped into a given form through machining and is applied to the sizing press. Moreover, the normalizing-annealing may be omitted in accordance with the steel composition and the steel form.

The following examples are given in illustration of the invention and are not intended as limitations thereof.

EXAMPLE 1

A steel having a chemical composition as shown in the following Table 1 was melted in a converter, which was made into an ingot. Then, the ingot was forged into a bloom having a square of 450 mm, which was normalized at 1,000° C. for 10 hours and annealed at 750° C. for 15 hours. Thereafter, the bloom was subjected to rough machining and further to a heat treatment including oil quenching at 1,040° C. for 10 hours and tempering at 630° C. for 12 hours, which was finished into an anvil of given size and applied to a test in the sizing press. The crack depth measured in the test is also shown in Table 1.

TABLE 1

| Run | Chemical composition (wt %) | | | | | | | | | | Cr* | Crack** depth | |
|---|---|---|---|---|---|---|---|---|---|---|---|---|---|
| No. | C | Si | Mn | Cr | Mo | V | N | Al | REM | others | equivalent | (mm) | Remarks |
| 1 | 0.41 | 0.38 | 0.77 | 2.45 | 1.29 | 0.51 | 0.004 | 0.003 | — | Ni:1.33 | −7.84 | more than 60 | Comparative Example |
| 2 | 0.40 | 0.25 | 0.73 | 1.10 | 0.23 | — | 0.003 | 0.005 | — | — | −13.97 | more than 60 | |
| 3 | 0.05 | 0.35 | 0.21 | 12.45 | 0.40 | 0.10 | 0.020 | 0.002 | — | Ni:4.05 | −1.95 | more than 60 | |
| 4 | 0.05 | 0.65 | 0.35 | 13.15 | 0.40 | 0.08 | 0.008 | 0.005 | — | — | 16.65 | 31 | |
| 5 | 0.30 | 0.55 | 0.41 | 6.20 | 1.26 | 0.58 | 0.006 | 0.003 | — | — | 7.96 | 22 | |
| 6 | 0.20 | 1.01 | 0.39 | 8.10 | 1.25 | 0.48 | 0.010 | 0.003 | — | — | 15.40 | 4 | First invention |
| 7 | 0.12 | 0.95 | 1.20 | 9.53 | 1.05 | 0.31 | 0.024 | 0.003 | — | — | 14.96 | 3 | |

TABLE 1-continued

| Run No. | Chemical composition (wt %) C | Si | Mn | Cr | Mo | V | N | Al | REM | others | Cr* equivalent | Crack** depth (mm) | Remarks |
|---|---|---|---|---|---|---|---|---|---|---|---|---|---|
| 8 | 0.25 | 0.99 | 0.42 | 8.30 | 1.15 | 0.50 | 0.012 | 0.018 | | — | 13.36 | 3 | Second |
| 9 | 0.24 | 1.22 | 1.40 | 12.50 | 1.20 | 0.25 | 0.051 | 0.008 | 0.008 | — | 13.54 | 2 | invention |
| 10 | 0.13 | 1.02 | 0.90 | 9.62 | 1.02 | 0.28 | 0.020 | 0.002 | 0.010 | — | 15.32 | 2 | |
| 11 | 0.26 | 1.03 | 1.00 | 9.11 | 1.31 | 0.32 | 0.008 | 0.24 | — | — | 14.29 | 3 | |

*Cr equivalent = Cr + 6 Si + 4 Mo + 11 V + 12 Al − 40 C − 2 Mn − 30 N(−4 Ni)
**Crack depth after the forging of 3000 slabs in sizing press

EXAMPLE 2

A steel having a chemical composition as shown in the following Table 2 was melted in a converter, which was made into an ingot. Then, the ingot was forged into a bloom having a square of 450 mm, which was subjected to a heat treatment including quenching and tempering and then finished into an anvil of given size for hot working press tool and applied to a test in the sizing press. The length of notch-like scale after the heat treatment at 950° C. for 15 hours and the crack depth measured in the test are also shown in Table 2.

TABLE 2

| Run No. | C | Si | Mn | P | S | Ni | Cr | Mo | V | Cr/Ni | Length of* notch-like scale (μm) | Crack depth** (mm) | Remarks |
|---|---|---|---|---|---|---|---|---|---|---|---|---|---|
| 1 | 0.55 | 0.20 | 0.80 | 0.002 | 0.004 | 1.65 | 1.21 | 0.36 | 0.16 | 0.73 | 96 | — | Comparative |
| 2 | 0.41 | 0.38 | 0.77 | 0.019 | 0.006 | 1.33 | 2.45 | 1.29 | 0.51 | 1.84 | 45 | more than 60 | Example |
| 3 | 0.35 | 0.99 | 0.39 | 0.003 | 0.004 | 1.50 | 4.75 | 1.30 | 0.54 | 3.16 | 15 | 21 | |
| 4 | 0.40 | 0.50 | 0.40 | 0.015 | 0.005 | 0.50 | 5.00 | 1.25 | 0.51 | 10.0 | 7 | 5 | Third |
| 5 | 0.35 | 1.30 | 0.39 | 0.003 | 0.004 | 0.05 | 4.82 | 1.27 | 0.52 | 96.4 | 5 | — | invention |
| 6 | 0.35 | 1.95 | 0.38 | 0.003 | 0.003 | 0.03 | 4.72 | 1.26 | 0.52 | 94.4 | 3 | — | |
| 7 | 0.36 | 1.31 | 0.39 | 0.004 | 0.005 | 0.07 | 7.90 | 1.35 | 0.56 | 112.9 | 5 | — | |
| 8 | 0.30 | 0.55 | 0.41 | 0.005 | 0.003 | 0.20 | 4.93 | 1.26 | 0.58 | 24.7 | 4 | 7 | |
| 9 | 0.31 | 0.60 | 0.42 | 0.005 | 0.003 | 0.15 | 5.12 | 1.30 | 0.55 | 34.1 | 5 | 6 | |
| 10 | 0.30 | 1.25 | 0.56 | 0.004 | 0.003 | 0.08 | 5.90 | 0.90 | 0.59 | 73.8 | 4 | — | |
| 11 | 0.29 | 1.45 | 0.62 | 0.004 | 0.002 | 0.06 | 6.20 | 0.85 | 0.61 | 103.3 | 5 | — | |
| 12 | 0.30 | 1.32 | 0.56 | 0.004 | 0.002 | 0.15 | 6.15 | 0.92 | 0.60 | 41.0 | 6 | 3 | |

*measured at room temperature after heating at 950° C. for 15 hours in air
**Crack depth (mm) after forging of 1000 slabs in sizing press (—: not measured)

As mentioned above, according to the invention, the improvement of the resistance to thermal fatigue, which is lacking in the conventional steel for hot working press tools, can be achieved, so that the steels according to the invention can advantageously be applied to hot working press tools suitable for a slab width sizing press.

What is claimed is:

1. A steel for a hot working press tool used for continuously reducing a slab width consisting essentially of C: 0.05–0.35 wt %, Si: 0.80–2.5 wt %, Mn: 0.10–2.0 wt %, Cr: 7.0–13.0 wt %, Mo: 0.50–3.0 wt %, V: 0.10–0.60 wt %, N: 0.005–0.10 wt %, the balance being iron and inevitable impurities, and satisfying a Cr equivalent of not more than 16 represented by the following equation:

$$\text{Cr equivalent} = \text{Cr} + 6\text{Si} + 4\text{Mo} + 11\text{V} - 40\text{C} - 2\text{Mn} - 30\text{N (wt \%)}.$$

2. A steel for a hot working press tool used for continuously reducing a slab width, consisting essentially of C: 0.05–0.35 wt %, Si: 0.80–2.5 wt %, Mn: 0.10–2.0 wt %, Cr: 7.0–13.0 wt %, Mo: 0.50–3.0 wt %, V: 0.10–0.60 wt %, N: 0.005–0.10 wt %, the balance being iron and inevitable impurities, and further containing at least one of Al: 0.005–0.05 wt % and rare earth metal: 0.005–0.02 wt %, and satisfying a Cr equivalent of not more than 16 represented by the following equation:

$$\text{Cr equivalent} = \text{Cr} + 6\text{Si} + 4\text{Mo} + 11\text{V} + 12\text{Al} - 40\text{C} - 2\text{Mn} - 30\text{N (wt \%)}.$$

3. A steel for a hot working press tool used for continuously reducing a slab width, consisting essentially of C: 0.10–0.45 wt %, i: 1.22–2.0 wt %, Mn: 0.10–2.0 wt %, Mo: 0.50–2.0 wt %, V: 0.50–0.80 wt %, Cr: 3.0–8.0 wt % and Ni: 0.05–1.2 wt %, provided that Cr/Ni≧41, the balance being iron and inevitable impurities.

* * * * *